US008793910B2

(12) United States Patent
Froio et al.

(10) Patent No.: US 8,793,910 B2
(45) Date of Patent: Aug. 5, 2014

(54) FRAME FOR A SIGN

(75) Inventors: Vito Saverio Froio, Aurora (CA); Scott Fraser, Newmarket (CA); Antony Edward Rubino, Maple (CA); Thomas Grant Nisbet, Mississauga (CA)

(73) Assignee: Verde Fastframe Incorporated, Richmond Hill, Ontario (CA)

( * ) Notice: Subject to any disclaimer, the term of this patent is extended or adjusted under 35 U.S.C. 154(b) by 0 days.

(21) Appl. No.: 12/898,247

(22) Filed: Oct. 5, 2010

(65) Prior Publication Data

US 2011/0185610 A1 Aug. 4, 2011

Related U.S. Application Data

(60) Provisional application No. 61/248,604, filed on Oct. 5, 2009.

(51) Int. Cl.
*G09F 7/02* (2006.01)

(52) U.S. Cl.
USPC ..... 40/606.17; 160/374.1; 40/734; 40/611.06

(58) Field of Classification Search
USPC ..... 40/606.17, 611, 5, 152, 605, 618, 624, 40/611.06, 611.08, 782, 611.05; 160/374.1, 379; 248/476, 477, 490, 248/486; 38/102–102.91
See application file for complete search history.

(56) References Cited

U.S. PATENT DOCUMENTS

| | | | | | |
|---|---|---|---|---|---|
| 1,253,847 | A | * | 1/1918 | Lynch | 40/606.17 |
| 2,470,129 | A | * | 5/1949 | Bemis et al. | 160/397 |
| 3,778,915 | A | * | 12/1973 | Freeman et al. | 40/605 |
| 4,050,498 | A | * | 9/1977 | Lucchetti | 160/374.1 |
| 4,255,886 | A | * | 3/1981 | Klarman | 38/102.3 |
| 4,301,853 | A | * | 11/1981 | Vidal | 160/374.1 |
| 4,373,279 | A | * | 2/1983 | Abel et al. | 40/739 |
| 4,882,866 | A | * | 11/1989 | Gebhardt | 40/611.01 |
| 4,986,013 | A | * | 1/1991 | Pollack | 40/783 |
| 5,617,660 | A | * | 4/1997 | Pollack | 40/606.17 |
| 5,839,214 | A | * | 11/1998 | Peterson | 38/102.4 |
| 5,983,543 | A | * | 11/1999 | Hillstrom | 40/574 |
| 8,015,736 | B2 | * | 9/2011 | Frey | 40/549 |
| 2005/0016047 | A1 | * | 1/2005 | Yamagishi | 40/782 |

FOREIGN PATENT DOCUMENTS

| | | |
|---|---|---|
| CA | 2697204 | 9/2010 |
| EP | 0508729 | 10/1996 |

* cited by examiner

*Primary Examiner* — Charles A Fox
*Assistant Examiner* — Shin Kim
(74) *Attorney, Agent, or Firm* — Welsh Flaxman & Gitler LLC

(57) ABSTRACT

A frame for a sign. The frame comprises a plurality of struts and corner brackets. The struts have an exposed front surface including a gripping means. Each corner bracket slidably engages with two of the struts at an angle. The corner brackets also have an exposed front surface including a gripping means. The gripping means of the struts is substantially continuous with the gripping means of the corner brackets so that when the corner brackets and struts are engaged to form a polygon, the polygon includes a substantially continuous gripping means that is engageable with a sign to mount the sign on the frame.

9 Claims, 9 Drawing Sheets

FRAME FOR A SIGN

CROSS REFERENCE TO RELATED APPLICATION

This application claims the benefit of U.S. Provisional Patent Application No. 61/248,604, filed Oct. 5, 2009, entitled FRAME FOR A SIGN.

FIELD OF THE INVENTION

The present invention relates to a frame for a sign. The present invention more specifically relates to a frame that can be assembled without screws and that comprises a groove for mounting a sign to the frame.

BACKGROUND OF THE INVENTION

Most retail businesses place signage at their retail locations. Typically, the signage is either freestanding or hanging. Freestanding signage usually comprises an aluminum frame and a vinyl sign while hanging signage usually comprises a hanging vinyl sheet.

Freestanding signage is constructed with screws and is not very rigid. It requires time consuming assembly using many parts, is expensive to manufacture, and has high shipping costs. It is also not typically possible to change the signs using the same frame of the signage so as to reduce waste and cost.

Hanging signage, meanwhile, often curls or deforms over time, since it typically does not include a fully encompassing frame. Those that have a frame suffer from the same problems as freestanding signage.

What is required therefore, is signage that is easy and quick to assemble, has reusable parts and causes less waste.

SUMMARY

The present invention provides a frame for a sign comprising: (a) a plurality of struts having an exposed front surface including a gripping means along the length thereof; and (b) a plurality of corner brackets, the corner bracket slidably engageable with two of the struts at an angle, the corner bracket having an exposed front surface including a gripping means substantially continuous with the gripping means of the two struts; wherein the corner brackets and struts form a polygon when engaged, the polygon including a substantially continuous gripping means that is engageable with a sign to mount the sign on the frame.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

Overview

Figure 1:
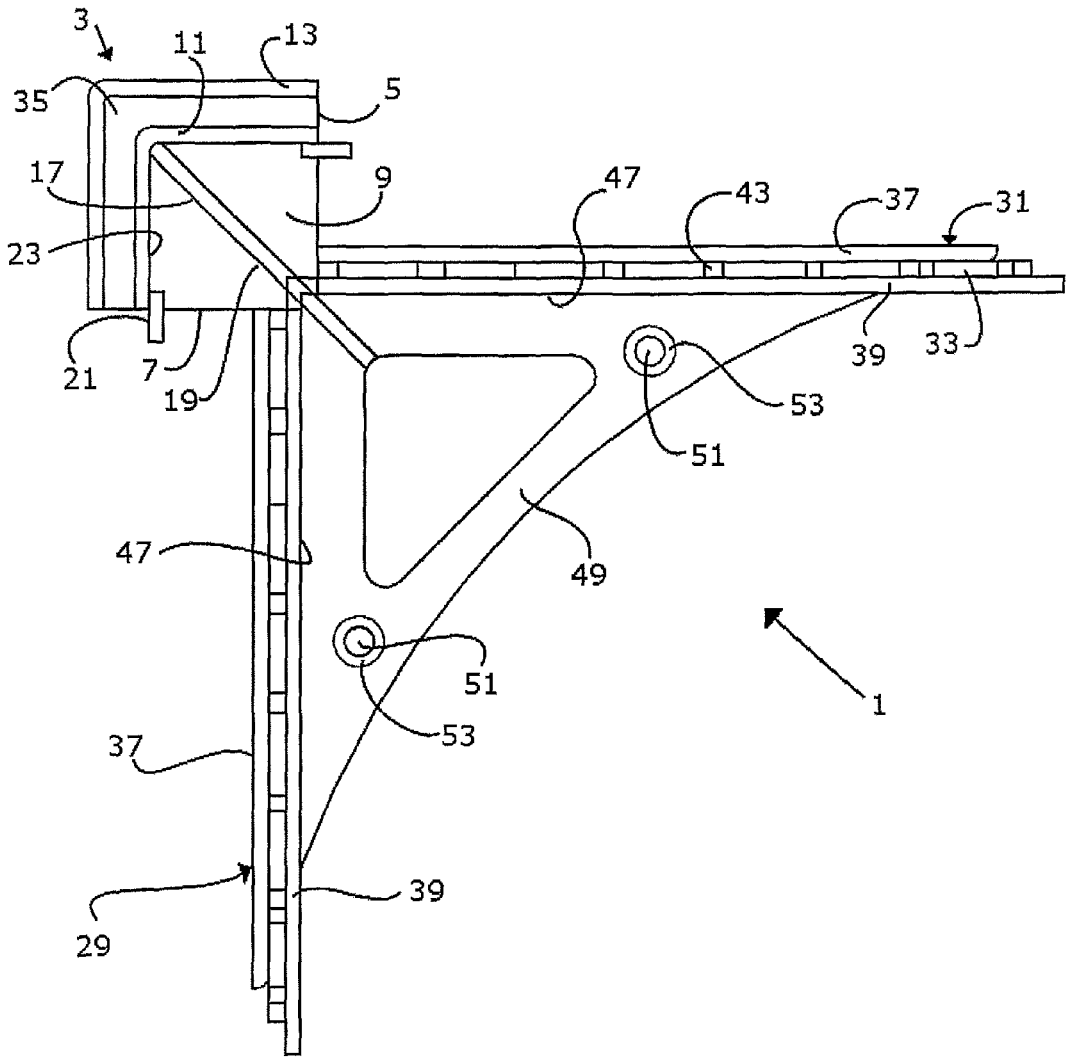
FIG. 1 illustrates a front view of a corner bracket of the frame.

The present invention provides a frame for a sign. The frame of the present invention enables faster delivery and reduced installation/distribution cost compared to existing frames. The frame also preferably comprises recycled materials for a reduced environmental impact.

The frame may be lightweight and assembled without screws. The assembled frame may provide a flush exposed edge on the front and optionally rear surfaces.

The frame can be provided to a retailer unassembled and may be quickly and easily assembled by the retailer without requiring tools. This allows the frame to be distributed in a smaller package with minimal packaging and, therefore, at a low cost. Once assembled, a sign can be affixed to the frame.

The frame may include parts that engage by sliding and locking together to provide a frame that is structurally rigid. For example, each edge component, which may be a strut, can slide and lock onto a corner component. The retailer can, for example, slide and lock four edge components onto four corner components to assemble a rectangular frame. A sign can then be removably mounted to the frame. The frame may also include a means for mounting the frame to a wall.

A sign can be mounted on the frame without tools. The frame may comprise a gripping means for removably mounting the sign to the frame. The gripping means is designed to grip the sign while enabling a retailer to remove the sign from the gripping means without tools and without damaging the sign or the gripping means.

The gripping means may be a groove and the sign may include a spline operable to be engaged by the groove. This spline and groove assembly enables easy removal of the sign, which is advantageous in that the sign can be removed for washing to extend its life or signs may be switched without costly installation or replacing the frame. The spline and groove assembly enables a sign to be installed on the front of the frame, on the rear of the frame or wrapped around the frame. Additionally, two signs may be installed on the frame, one on front of the frame and one on the rear of the frame.

The frame comprises a plurality of corner brackets, a plurality of struts and optionally a plurality of mullion brackets and mullions. The struts are slidably engageable with the corner brackets.

Each corner bracket is operable to link two struts at an angle, for example a 90° angle. The struts may be any length. In one particular embodiment, the frame is rectangular and comprises four 90° corner brackets and four struts; wherein the top and bottom struts have a substantially equal length and the left and right side struts have a substantially equal length. However it should be understood that the frame could comprise corner brackets of various angles and unequal length struts as long as each corner bracket links two struts together. For example, a frame in the shape of a pentagon, octagon or other polygon could be provided. Additionally, the struts need not be straight and could be curved or bent.

A strut includes a first end and a second end. A strut also includes an exposed edge surface and exposed front and optionally rear surfaces. The corner brackets may be provided with a corner piece that abuts an end of each of the two struts engaged to the corner bracket. The corner piece is provided with an exposed edge surface and exposed front and optionally rear surfaces that are flush with those of the strut when the corner bracket is engaged to the strut. Thus a producer or assembler of the frame is not required to manually form mitre joints for aesthetic reasons when linking the struts.

A stabilizing tab may be provided on the corner bracket for aligning the strut with the corner bracket to provide a flush or aligned front and rear surface of the frame.

Optionally, one or more mullion brackets and mullions may be provided for increasing the rigidity of the frame, which is desirable especially if the frame is particularly large. For example in a rectangular frame, a vertical mullion may be provided between a mullion bracket engaged with the top strut and a mullion bracket engaged with the bottom strut at a distance equidistant from and an angle parallel to the left and right struts. Both vertical and horizontal mullions may be provided as the mullion brackets and mullions can be constructed in a lattice.

The corner brackets and optionally the mullion brackets may also comprise a mounting plate for mounting or hanging the frame on a wall or other mount. The mounting plate includes at least one hole for receiving a screw to be attached to a mounting surface, for example a wall. The frame can also be hung so as to expose to a person both its front and rear side.

A sign can be mounted on the frame without tools by inserting into the frame a spline sewn to the sign. The sign is preferably a cloth and can be mounted on the front of the frame or on the rear of the frame in a wrap around configuration. Two signs may be mounted, one on each side of the frame.

The frame may comprise recyclable material, for example recycled plastics from recycled plastic bags. The struts may be formed using an extension process, as is known in the art. Preferably in the extrusion process the temperature is kept consistent. The corner brackets may be formed using a plastic injection moulding process, as is known in the art.

Frame

The frame may be lightweight and can be assembled without screws. Preferably the frame comprises a plastic and more preferably a recycled plastic, for example from recycled plastic bags. Optionally, the frame can be produced in any particular colour. The thickness of the plastic, as described more fully below, provides rigidity. In one example, the thickness of the plastic is between 0.05 and 0.25 inches. More preferably, the thickness of the plastic is between 0.1 and 0.2 inches.

Figure 9:
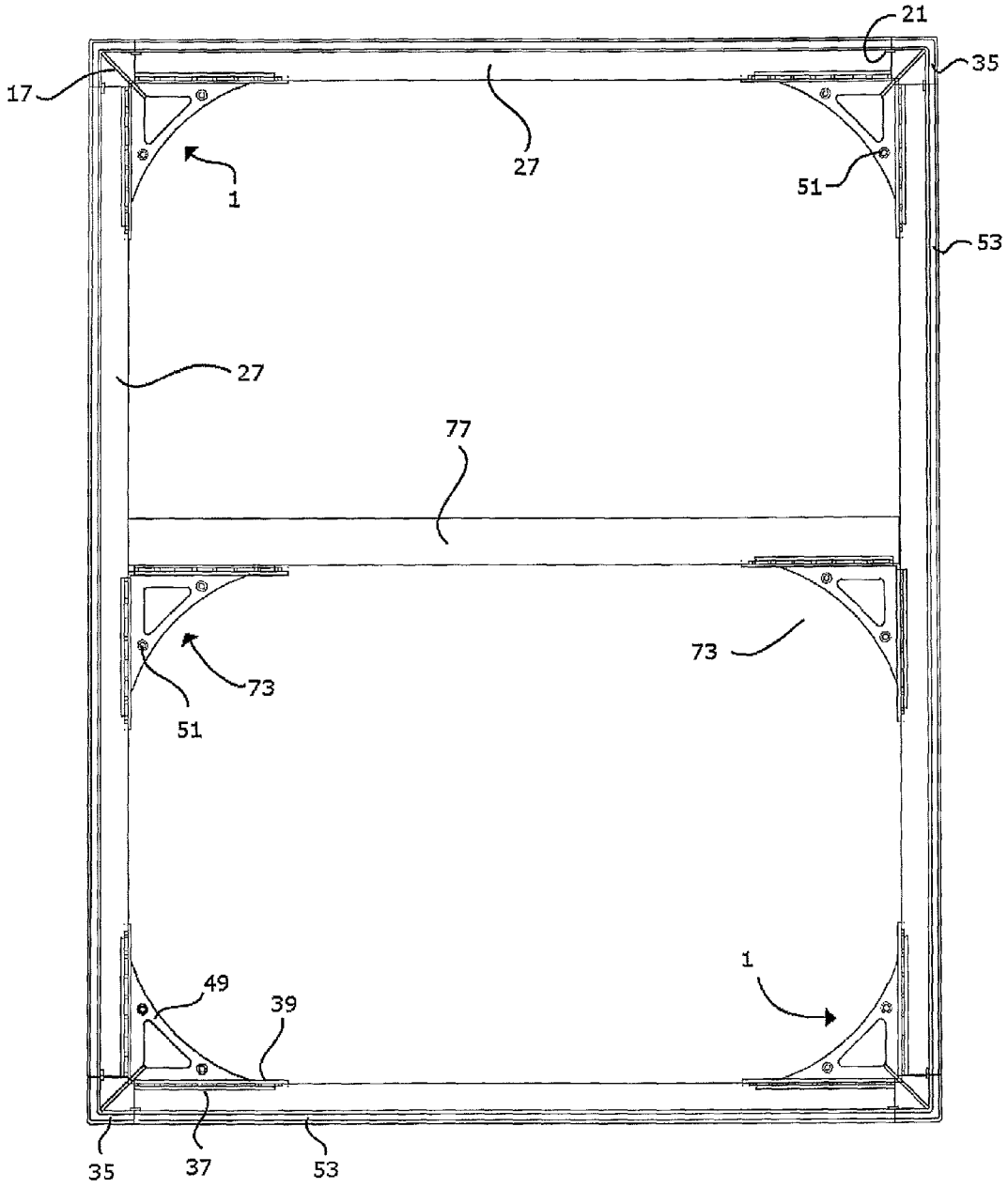
FIG. 9 illustrates an assembled frame including a mullion.

As previously mentioned the frame comprises a plurality of corner brackets, a plurality of struts and optionally a plurality of mullion brackets. An example of one embodiment of the present invention is shown in FIG. 9. The frame is comprised of four corner brackets (1), four struts (27), two mullion brackets (73) and one mullion (77). Each corner bracket (1) has two struts (27) connected. The assembled frame has a continuous spline receiving groove (35,53) on the exposed front and/or rear of the frame.

Corner Bracket

FIG. 1. illustrates a corner bracket. The corner bracket (1) is an operable to link two struts at a desired angle, for example a 90° angle.

Near the corner of the corner bracket is disposed a corner piece (3). The corner piece (3) may be formed with one edge (5) to abut a first end of a first strut slidably engaged to the corner bracket and with a second edge (7) to abut a second end of a second strut slidably engaged to the corner bracket (1). The corner piece (3) may comprise a plane (9) from which opposing inner flanges (11) and opposing outer flanges (13) extend. The inner flanges (11) may be disposed within the frame at a predetermined distance from the outer flanges (13) so as to define a spline receiving groove (35). The outer flanges (13) define an outer surface of the corner of an assembled frame.

The corner piece (3) may include opposing stiffening gussets (17) that diagonally bisect the corner piece (3) from about the inner flange (11) to about a point defined by two edge parts (19), on each side of the two sided corner piece (3). The stiffening gusset (17) provides both aesthetic appeal and increased rigidity.

The corner piece (3) may include a stabilizing tab (21) extending from an inner surface (23) of the inner flanges (11) of each edge (5, 7). The stabilizing tab (21) may be disposed on the corner piece (3) so as to enter a channel (25) of the strut (27) (shown in FIG. 5) when the strut (27) is engaged to the corner bracket (1) providing increased rigidity.

The corner bracket (1) may comprise two edge parts (29, 31) disposed at the desired angle. Each edge part (29, 31) may be similarity formed, however each edge part (29, 31) could be provided at different lengths. Preferably the two edge parts (29, 31) are the same so that the corner bracket (1) can be rotated without affecting its functionality.

Figure 2:
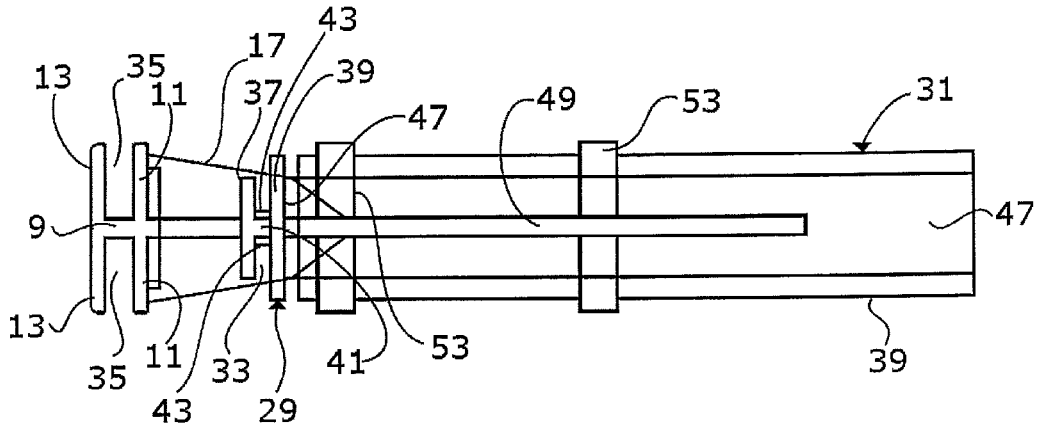
FIG. 2 illustrates a side view of the corner bracket.

Referring now to FIG. 2, each edge part (29, 31) may include two opposing receiving grooves (33) defined by outer flanges (37) and inner flanges (39) extending perpendicularly from a connecting member (41). The strut (27) may be slidably engaged with the corner bracket (1) by the receiving grooves (33). The receiving grooves (33) may comprise one or more protrusions (43) extending slightly from each side of the connecting member (41) for increasing the tension and rigidity of the frame when a strut (27) is engaged to the corner bracket (1).

Figure 3:
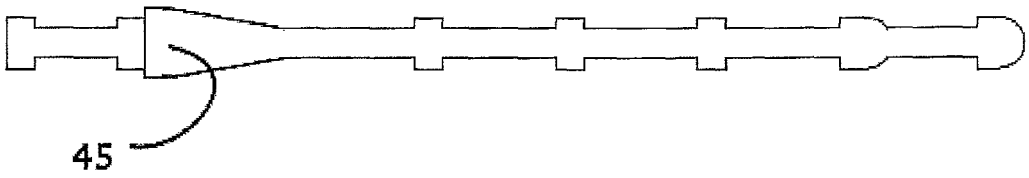
FIG. 3 illustrates an arrow head lock.
Figure 8:
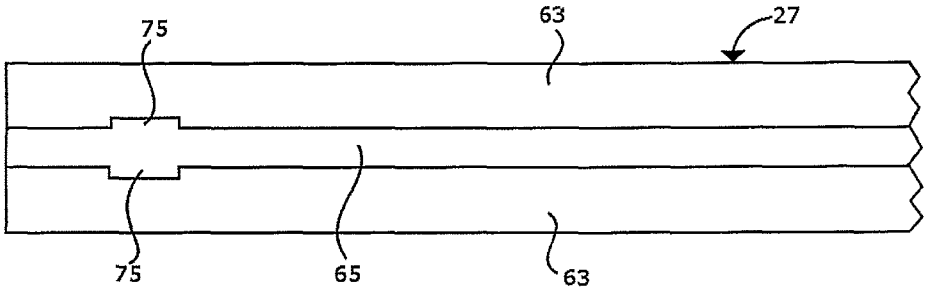
FIG. 8 illustrates a bottom view of the strut comprising a locking tab for locking the corner bracket to the strut.

Additionally, one or more of the protrusions (43) may be provided as a locking means. For example an arrow head lock (45) as shown in FIG. 3 may be provided, wherein the arrow head lock (45) cooperates with a locking tab (75) on the strut as shown in FIG. 8, as will be described below.

The outer flanges (37) may be less deep than the inner flanges (39) at least by the thickness of the strut material so that the assembled frame has flush surfaces. The receiving grooves (33) may be slightly greater than the thickness of the strut material, as will be more fully described.

Extending perpendicularly from an inner surface (47) of the inner flanges (39) of the edge parts (29, 31) may be a mounting plate (49). The mounting plate (49) may include at least one screw hole (51) for receiving a screw for affixing the frame to a wall. Optionally, screw nubs (53) extending perpendicularly from the mounting plate may be provided for guiding the screws.

Struts

Figure 5:
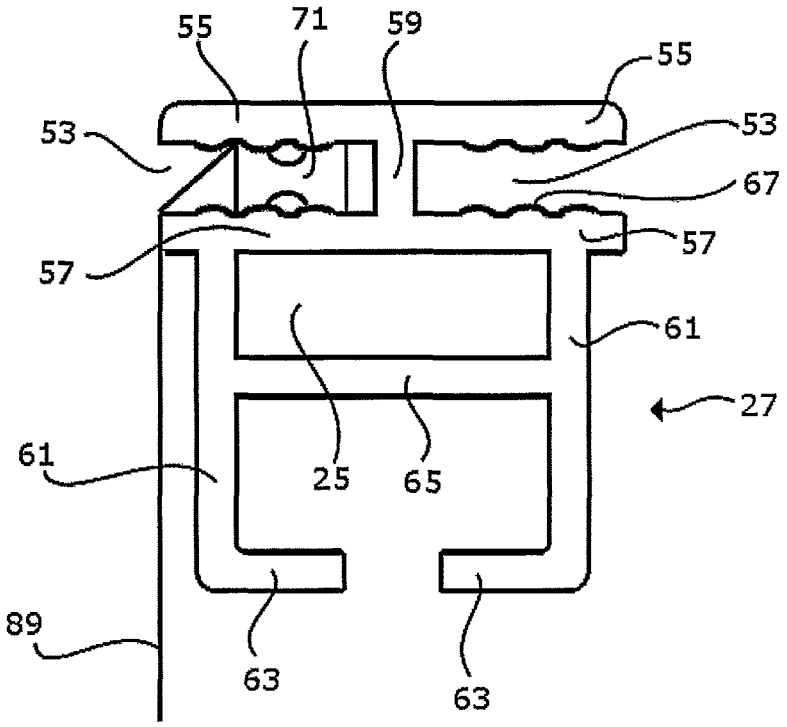
FIG. 5 illustrates a side view of a strut.

FIGS. 5 and 8 illustrate a strut. The strut (27) may be provided at any length as it is preferably formed by an extrusion process, as is known in the art.

The strut (27) may comprise two opposing spline receiving grooves (53) defined by outer flanges (55) and inner flanges (57) extending perpendicularly from a connecting member (59). Along the spline receiving groove (53) may be one or more spurs (67) for securely holding a spline, as described below.

Extending perpendicularly from each inner flange (57) opposite of the connecting member may be a vertically extending member (61). The vertically extending members (61) may be parallel but offset from the connecting member (59). Extending inward and perpendicularly from each vertically extending member (61) at its other end may be an engagement flange (63). The engagement flange (63) may be slidably engaged with the receiving groove (33) of the corner bracket (1). Preferably the engagement flange (63) has a depth less than the inner flange (39) of the corner bracket (1) by at least the thickness of the connecting member (41) of the corner bracket (1). The vertically extending members (61) of the strut have a distance between them about equal to the depth of the inner flange (39) of the corner bracket (1), therefore providing a flush surface when the strut (27) is slidably engaged to the corner bracket (1).

Optionally the strut (27) may include a channel (25) defined by the inner flange (57), the opposing vertically extending members (61), and one or more stiffening panels (65) disposed between the vertically extending members (61). The channel (25) can receive a stabilizing tab (21) extending from the corner piece (3).

As shown in FIG. 8, a cut out may be provided near the ends of the strut to provide a locking tab (75) in which the locking means of the corner bracket (1), such as the arrow head lock (45), engages.

Mullion Brackets

Figure 4:
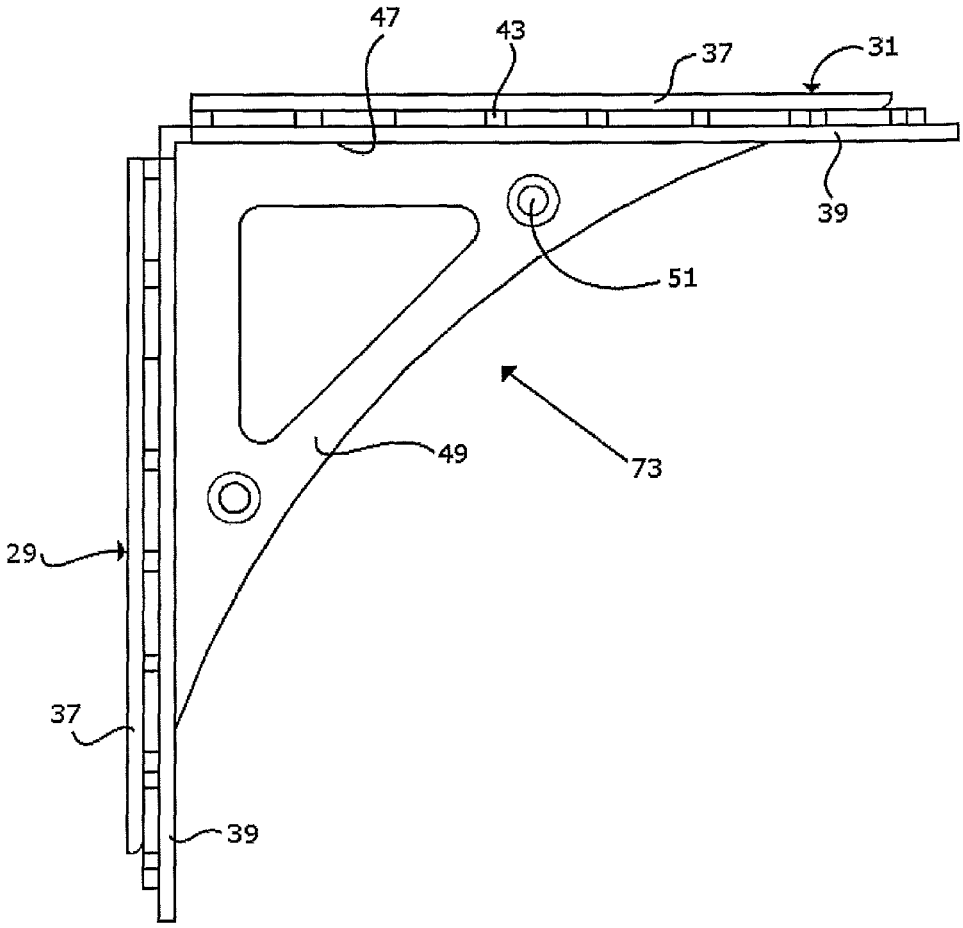
FIG. 4 illustrates a front view of a mullion bracket.

FIG. 4 illustrates a front view of a mullion bracket. A mullion bracket may be provided as substantially the same as a corner bracket without a corner piece or a locking means. This enables the mullion bracket to slidably engage a strut at any distance along the strut. For example, the mullion bracket may be slidably engaged at the middle of the length of a strut. The other edge part of the mullion bracket may be slidably engaged to a mullion. Each edge part may be similarly formed, however each edge part may be provided at different lengths.

Mullions

Figure 6:
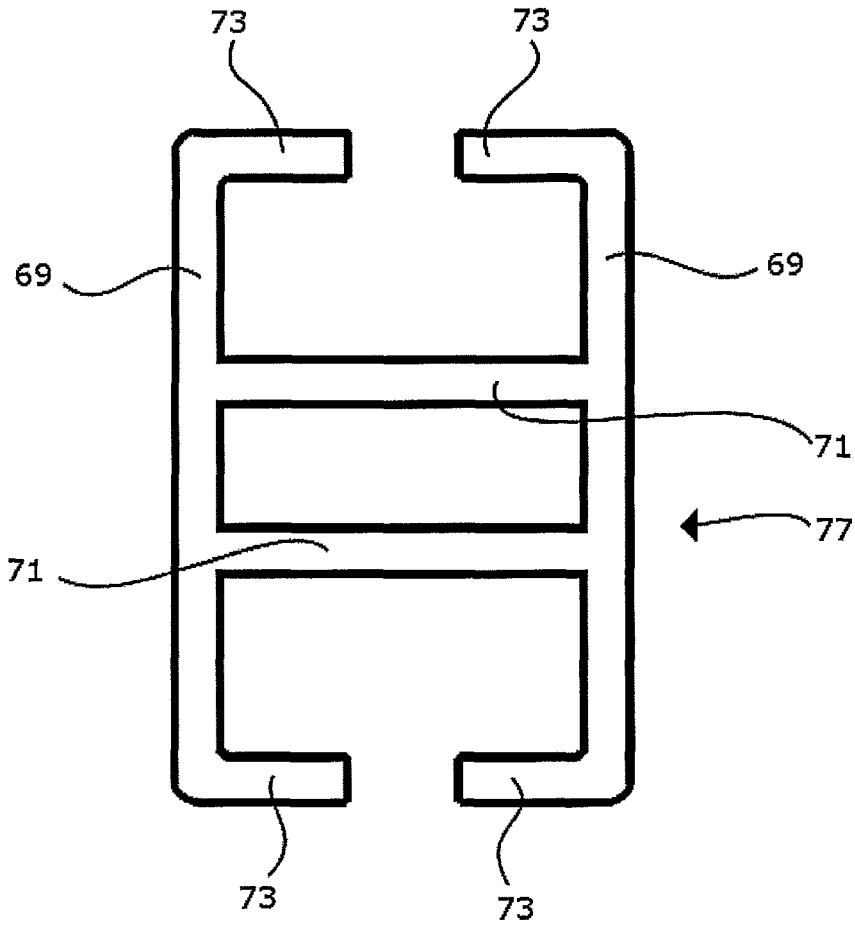
FIG. 6 illustrates a side view of a mullion.

FIG. 6 illustrates a mullion. A mullion (77) may comprise two parallel vertically extending members (69) connected by at least one stiffening panel (71). At the ends of the parallel vertically extending members (69) may be engagement flanges (73). Each of these elements has similar characteristics to those of the strut (27) as described above.

Sign

The sign is preferably provided as a cloth. The cloth is preferably washable without causing fading of any ink used on the cloth.

Figure 7:
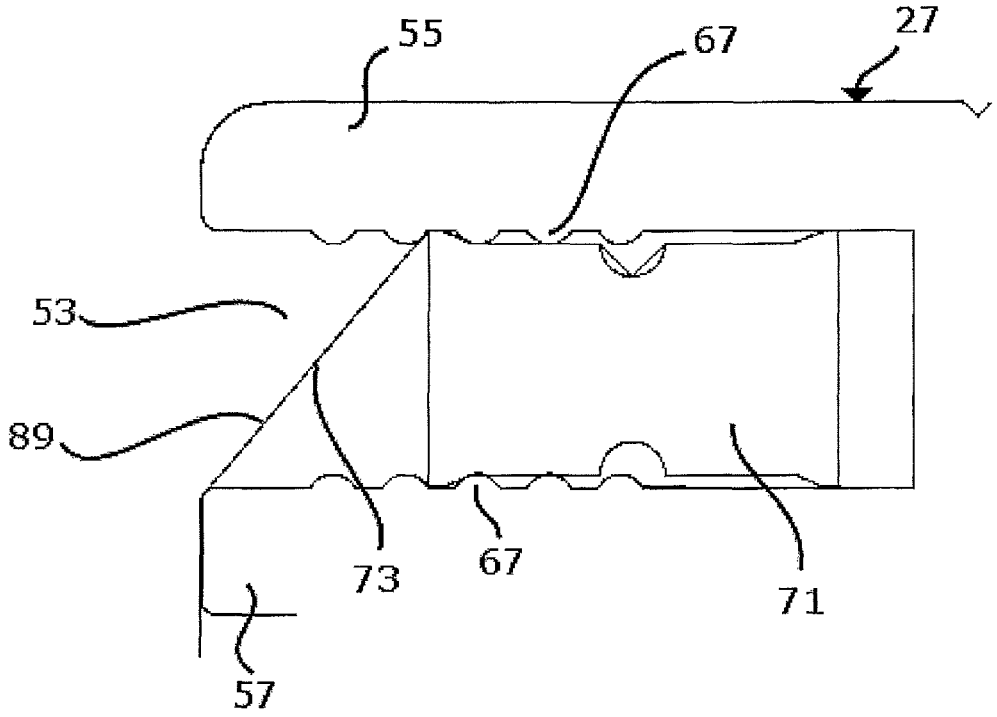
FIG. 7 illustrates a spline and a spline receiving groove for mounting a sign on the frame.

FIG. 7 illustrates the sign mounted to the frame. The sign (69) near its edges may be sewn or otherwise affixed to a spline (71) disposed along the perimeter of the sign. The spline (71) is preferably made of a flexible silicone and is sized so as to be receivable in the spline receiving groove (35, 53) of the corner brackets (1) and struts (27).

To mount the sign, the spline (71) may be inserted to the spline receiving groove (35, 53). To allow for a tolerance in the dimension of the sign, the spline (71) may be inserted to a particular depth into the spline receiving grooves (35, 53) and may be held securely by the one or more spurs (67). Further inserting the spline (71) increases the tension of the sign. Additionally, tension along a diagonal (73) portion of the sign near the spline (71) may increase engagement of the spur (67) to resist slippage.

As previously mentioned, the sign may be mounted either to the front of the frame or the rear of the frame in a wrap around configuration. The sign is preferably sized to either: (i): approximately the dimensions of the spline receiving groove (35, 53) along the perimeter of the frame (for a front mount or front and rear mount); or (ii) approximately the size of the frame plus the depth of the frame plus the thickness of the material (for a wrap around mount).

Assembly

FIG. 9 illustrates an assembled frame. A frame may be assembled by slidably engaging a first end of a first strut to a first edge of a first corner bracket. The first strut is slid onto the first corner bracket until a first end of the first strut is disposed approximately adjacent to an edge of the first corner bracket, at which point the locking means may lock the strut in the locking tab.

One or more mullion brackets may be slid along the strut at various positions along its length. The second end of the first strut is then slidably engaged to a first end of a second strut, until locked, to define a bottom edge of the frame.

Left and right struts and vertical mullions may be similarly affixed to the frame. Optionally, horizontal mullion brackets may be slid onto the left and right struts and vertical mullions if desired mullion brackets are then engaged to the mullions along their top end at a level coplanar with the top end of the left and right struts. A corner bracket may also be engaged to the left or right strut.

A top strut may be slidably engaged along the mullion brackets and the corner bracket, and finally a fourth corner bracket may be slidably engaged to complete the frame.

A sign may be mounted on the front, the front and rear, or in a wrap around configuration by placing the spline in the spline receiving groove around the perimeter of the frame. The spline may be inserted so as to provide the desired tension for the sign.

To remove the sign, the spline may be pulled from the spline receiving groove. It may be cleaned or replaced by a new sign.

The above described embodiments of the present invention are meant to be illustrative of the preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

The invention claimed is:

1. A sign frame having an interior surface, an exterior surface, a front surface and a rear surface constructed from a plurality of components, said plurality of components comprising:

(a) a plurality of struts wherein each strut includes a spline receiving groove along a length thereof; and (b) a plurality of corner brackets having a gripping member, and wherein each corner bracket slidably engages with two struts to form a desired shape of the sign frame and wherein the gripping member of the struts is substantially continuous with the spline receiving groove of the corner brackets when the struts are engaged with the corner brackets and wherein the spline receiving groove is substantially continuous along the periphery of the sign frame and wherein the spline receiving groove of both the struts and corner brackets is on the rear surface or the front surface of the sign frame and wherein the spline receiving groove is for mounting a sign on the front surface or the rear surface of the sign frame.

2. The sign frame of claim 1 where the frame further includes one or more mullions and a plurality of mullion brackets, and wherein each of the mullions is slidably engaged to two mullion brackets and wherein the mullion brackets are slidably engaged to different struts.

3. The sign frame of claim 1 where the front exposed surface and the rear exposed surface of the sign frame both have a continuous spline receiving groove.

4. The sign frame of claim 1 where the corner brackets further include a locking means to secure the struts to the corner brackets.

5. The sign frame of claim 4 where the frame further includes one or more mullions and a plurality of mullion brackets, and wherein each mullion is slidably engaged to two mullion brackets and wherein the mullion brackets are slidably engaged to different struts.

6. The sign frame of claim 4 where the spline receiving groove of both the plurality of struts and the plurality of corner brackets is on an exposed surface facing a front of the sign frame and where the spline receiving groove is also on an exposed surface facing a rear of the sign frame.

7. The sign frame of claim 4 where the spline receiving groove of both the plurality of struts and the plurality of corner brackets is operable to grip a spline attached to a sign.

8. The sign frame of claim 1 where the corner brackets further include a locking means to secure the struts to the corner brackets.

9. A sign frame constructed from a plurality of components, wherein said plurality of components comprise:

a plurality of longitudinally extending struts each having one or two spline receiving grooves formed by an outer flange connected to an inner flange by a connecting member;

two opposed extending members that extend from the inner flange wherein each extending member terminates with an engagement flange extending perpendicularly towards the opposite extending member; and wherein there is a gap formed between the ends of the two engagement flanges;

a plurality of corner brackets wherein each corner bracket is comprised of two extending arms each extending arms comprised of:

an inner flange;

an outer flange;

a connecting member connecting the inner and outer flanges forming two receiving channels; and a corner piece connected to each of the extending arms comprising:

an inner flange;

an outer flange; and a connecting member connecting the inner and outer flanges forming two spline receiving grooves;

wherein the outer flange and the inner flange of each strut slidably engages the receiving channel of a corner bracket and wherein each corner bracket is slidably engaged with two struts to form a desired shape of a sign frame, and wherein the spline receiving grooves of the struts are substantially continuous with the spline receiving grooves of the corner brackets when the struts are engaged with the corner brackets, and wherein the gripping means is on the exposed surface of the completed sign frame.

* * * * *